United States Patent [19]

Speer

[11] Patent Number: 4,598,884

[45] Date of Patent: Jul. 8, 1986

[54] INFRARED TARGET SENSOR AND SYSTEM

[75] Inventor: Spencer J. Speer, Ontario, Calif.

[73] Assignee: General Dynamics Pomona Division, Pomona, Calif.

[21] Appl. No.: 676,021

[22] Filed: Nov. 28, 1984

[51] Int. Cl.[4] ..... F41G 7/26; F42B 13/10

[52] U.S. Cl. ..... 244/3.16; 102/476

[58] Field of Search ..... 244/3.16; 102/476

[56] References Cited

U.S. PATENT DOCUMENTS

| | | | |
|---|---|---|---|
| 2,418,137 | 4/1947 | Noell | 244/3.16 |
| 2,457,393 | 12/1948 | Muffly | 244/3.16 |
| 2,969,018 | 1/1961 | Erst et al. | 244/3.16 |
| 3,021,096 | 2/1962 | DeMott | 244/3.16 |
| 3,072,055 | 1/1963 | Ross | 244/3.16 |
| 3,782,667 | 1/1974 | Miller, Jr. et al. | 244/3.16 |
| 4,106,726 | 8/1978 | Emmons et al. | 244/3.16 |
| 4,131,248 | 12/1978 | Bergland | 244/3.16 |

FOREIGN PATENT DOCUMENTS 3300849 7/1984 Fed. Rep. of Germany ..... 244/3.16

*Primary Examiner*—Charles T. Jordan

*Attorney, Agent, or Firm*—Neil F. Martin; Edward B. Johnson

[57] ABSTRACT

A gimbal-less infrared (IR) target sensor for mounting in an IR transmissive nose cone of a guided missile comprises a fixed, concave, primary mirror mounted coaxially in the base of the nose cone; a fixed, convex, secondary mirror mounted at the focus of the primary mirror; and a plurality of IR sensing units having IR transmissive elements located around the periphery of the primary mirror. A shaped-charge is located aft of the primary mirror. The IR-transmissive elements incorporate IR-conductive fiber optics to transmit the IR signal to detectors aft of the shaped-charge for detection, processing, and missile guidance.

14 Claims, 4 Drawing Figures

INFRARED TARGET SENSOR AND SYSTEM

BACKGROUND OF THE INVENTION

1. Field of the Invention

The present invention relates generally to infrared target sensing and pertains particularly to a new and improved infrared guidance system for use with a shaped-charge carrying missile.

2. Description of the Prior Art

There are many applications where it is desirable to detect and track a target by sensing the infrared (IR) radiation emitted by the target. For example, a guided missile typically contains an IR sensing system in its nose cone for sensing the IR radiation emitted by a target. Typically, the IR information received is transmitted to a signal processor within the missile's guidance section for controlling the attitude of the missile. Previous IR sensors employ a complex, mechanical, gimballed seeker-head which scans the area in front of the missile until the target is located. Once the target is located, the gimballed seeker-head will lock-onto it and will track the target. Infrared signal information from the seeker head is processed in the missile's guidance control computers to maintain the missile's heading toward the target. Such gimbal systems require complex, electro-mechanical gyroscope control to establish a stable platform for reference from which to guide the missile. Such gimbal and gyroscopic control systems are typically extremely complex and expensive. They often require complicated optics which require precision placement. Also, because of their mass and mechanically moving parts, such prior art sensor systems are subject to vibration errors and sometimes require lubrication and maintenance.

Such prior art gimbal sensor systems are particularly undesirable for use with a shaped-charge missile. When the missile hits the target, the shaped-charge emits an explosive jet towards the nose of the missile for penetrating the target. It is well known that the amount of mass in front of the shaped-charge and the structure and configuration of that mass have a decided influence on the effectiveness of the explosive jet from the shaped-charge. The greater the mass and structural strength of materials, the more the explosive jet is inhibited.

Therefore, it is desirable to have an infrared sensor that is extremely simple and has no mechanical moving parts.

It is further desirable that such a sensor be of extremely low mass, particularly in the axial portion of the missile. It is further desirable that such a device structurally offer the minimum of resistance to a shaped-charge explosive jet.

SUMMARY OF THE INVENTION

According to the invention, and IR target sensor for mounting in an IR transmissive nose cone of a missile includes a fixed, concave, primary mirror mounted in the base of the nose cone for receiving IR radiation from a target. A secondary mirror mounted in the nose of the nose cone at the focus of the primary mirror reflects the IR radiation to a plurality of sensing units having transmissive elements positioned around the periphery of the primary mirror.

According to a further precept of the invention, the sensor is used in conjunction with a shaped-charge carrying missile. In an exemplary embodiment of this precept, the sensing units comprise transmissive elements incorporating an array of IR-transmissive, fiber optics located around the periphery of the shaped-charge for transmitting the IR information, and detectors located aft of the shaped-charge for receiving the IR information. In an exemplary embodiment, the center sections of the mirrors are thinned to provide minimum resistance to the explosive jet from the shaped-charge.

DETAILED DESCRIPTION OF THE INVENTION

Figure 1:
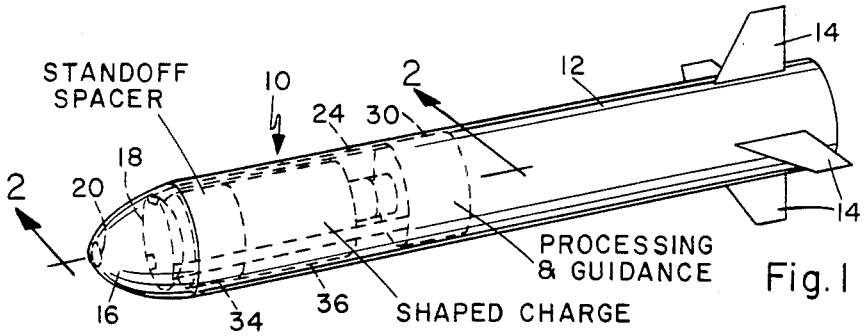
FIG. 1 illustrates a typical missile incorporating the infrared sensor of the present invention.

With reference now to the drawing, and more particularly to FIG. 1 thereof, there is shown a missile, designated generally by the numeral 10, which comprises a generally cylindrical and elongated body 12 having a plurality of radial fins or wings 14 extending radially outward from the body 12. Generally, one or more of the wings 14 are moveable for guiding the missile 10 during flight. At the fore end of the missile is a nose cone 16 formed of a generally IR-transparent material.

Figure 2:
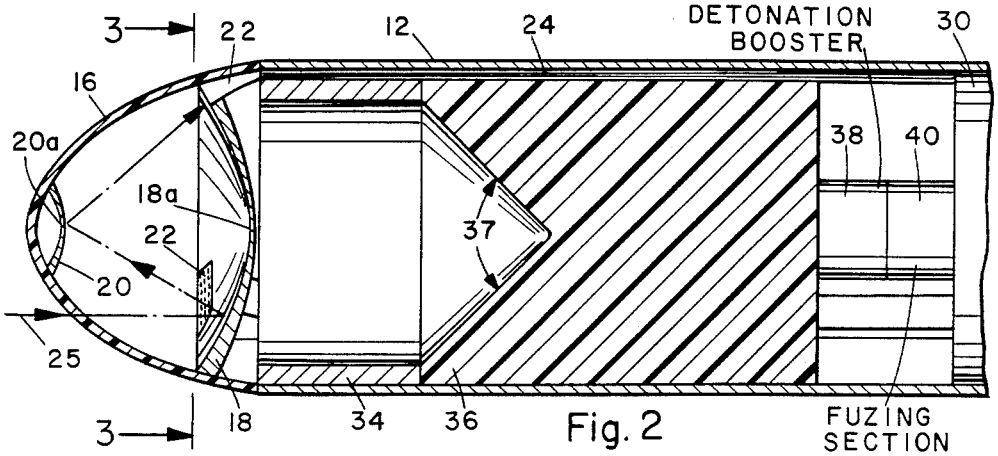
FIG. 2 is an enlarged sectional view taken on line 2—2 of FIG. 1.

The nose cone 16 with the enclosed sensor and accompanying components is now best described with reference to FIG. 2. A concave primary mirror 18 is mounted coaxially with the missile body 12 at the base of the nose cone 16. The primary mirror 18 has a thin center section to provide for less restrictive passage of an explosive jet from a shaped-charge, as will be subsequently explained. A seconary mirror 20, having a convex surface, is mounted at the focus of the primary mirror 18 near the apex of the cone 16 and is coaxially aligned with the primary mirror 18 and the axis of the missile body 12. The secondary mirror 20, also has a thin center section **20*a*** to provide for less restrictive passage of an explosive jet from a shaped-charge.

Figure 3:
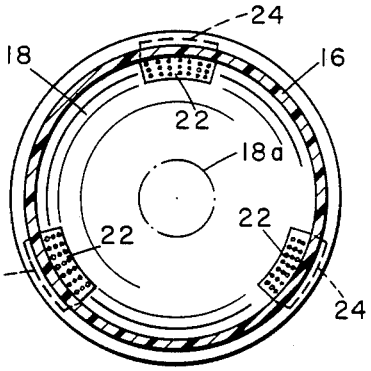
FIG. 3 is a sectional view taken on line 3—3 of FIG. 2.

A plurality of IR sensing units are shown to comprise IR transmissive elements 22 positioned around the periphery of the primary mirror 18. In an exemplary embodiment of the invention as depicted in FIG. 3, three elements 22 are equiangularly positioned about the periphery of the primary mirror 18. It has been found to be especially advantageous to locate detectors 26 aft of the shaped-charge. To accomplish the remote positioning of the detectors 26 each transmissive element 22 is an array of IR-conductive fiber optics 24.

In use, the IR sensor functions as follows. Incoming infrared radiation 25 from a target passes through the nose cone 16 to fall on the primary mirror 18 which focuses the radiation on the secondary mirror 20 which in turn reflects the radiation to the transmissive elements 22. In the exemplary embodiment in FIG. 3, three elements 22 are shown located around the periphery of the primary mirror 18. The information gathered by the three IR transmissive elements 22 is sufficient to form a triangulation of the target and determine its position. In this manner a gimbal-less IR sensor is created. The transmissive units 22 convey the incident infrared radiation to the detectors 26 and the resultant signals are resolved by the signal processor 28 and guidance system 30.

One enormous advantage of such a sensor as described above is its use in combination with a shaped-charge carrying missile. As shown in FIG. 2, a shaped-charge 36 is located aft of the primary mirror 18. A detonation booster 38 and fuzing section 40 are located aft of the shaped-charge 36. A ring-shaped, standoff spacer 34 is used to position the shaped-charge 36 the optimal distance from the nose of the missile 10. The cone angle 37 of the shaped-charge 36 largely determines the distance to and the shape of the explosive jet of the shaped-charge 36. Since any obstruction to the shaped-charge explosive jet seriously inhibits its penetration into the target, it is important that there be as little mass and structure as possible in front of the shaped-charge 36. The primary mirror 18 and the secondary mirror 20 require very little structure and mass and are therefore a great improvement over the previously used gimbal systems. Additionally, the primary mirror 18 may be thinned at the center section 18*a* to provide even less resistance to the explosive jet. The secondary mirror 20 may also have a thin center section 20*a* so as to provide less resistance to the explosive jet from the shaped-charge 36.

For use in conjunction with a shaped-charge, the IR transmissive elements 22 located around the periphery of the primary mirror 18, are preferably the ends of a bundle of IR conductive fiber optics 24 for transmitting the IR information received by the IR transmissive elements 22 to infrared detectors 26 in the missile guidance system 30 located aft of a shaped-charge 36. The fiber optics 24 run along the periphery of the shaped-charge 36 and therefore do not interfere with the explosive jet.

Figure 4:
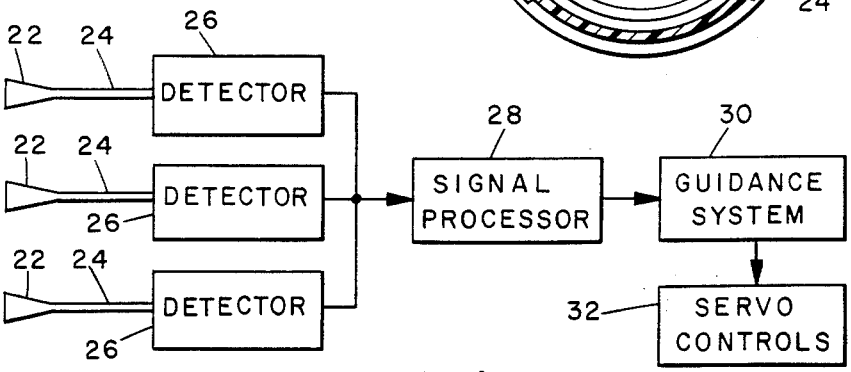
FIG. 4 is a block diagram depicting the relationship between the sensing system and the signal processing and guidance system of the missile.

As can be seen in the general system block diagram of FIG. 4, from the detectors 26 the IR information passes to a signal processor 28 for computing the location of the target. This information is transmitted to the missile's guidance system 30 which controls the servos 32 for controlling the fins 14 and therefore, the direction of the missile 10.

From the foregoing description, it will be seen that the present invention provides an extremely simple, efficient, and reliable manner of sensing IR radiation from a target. Additionally, the sensor provides a minimum of mass and structural resistance to the explosive jet of a shaped-charge.

Although the invention is described primarily in terms of IR missile guidance, this invention is not so restricted and may be applied to any other field where it is desirable to sense IR radiation. Accordingly, the present invention is to be construed as limited only by the spirit and scope of the appended claims. And, although a particular embodiment of the invention has been illustrated and described, modifications and changes will become apparent to those skilled in the art, and it is intended to cover in the appended claims, such modifications and changes as come within the strue spirit and scope of the invention.

Having described my invention, I now claim:

1. An infrared (IR) target sensor for mounting in an IR transmissive nose cone of a missile, said sensor comprising:

a primary mirror mounted in the base of a nose cone for receiving IR radiation from a target and for focusing the IR radiation on a secondary mirror;

said secondary mirror being mounted in the nose of said nose cone for receiving the IR radiation from said primary mirror, and for focusing the IR radiation on a plurality of IR transmissive elements; and said plurality of IR transmissive elements being positioned around the periphery of said primary mirror for receiving the IR radiation from said secondary mirror.

2. The sensor according to claim 1 wherein:

said primary mirror is concave.

3. The sensor according to claim 2 wherein:

said secondary mirror is convex and is mounted at the focus of said primary mirror.

4. The sensor according to claim 3 wherein:

said primary mirror and said secondary mirror each are formed with thin center sections to provide for less restrictive passage for an explosive jet of a shaped-charge.

5. The sensor of claim 1 in combination with:

a missile having a shaped-charge located aft of said sensor.

6. The sensor of claim 1 wherein:

said IR transmissive elements are equiangularly spaced about the periphery of said primary mirror.

7. The sensor according to claim 5 wherein each of said IR transmissive elements comprises:

an array of IR conductive fiber optics for transmitting the IR radiation to a plurality of detectors;

said detectors being for sensing the IR radiation; and said detectors are located aft of said shaped-charge.

8. An infrared (IR) target sensing system for use in combination with a shaped-charge in a missile, said system comprising:

a primary mirror mounted in the base of an IR transmissive nose cone for receiving IR radiation from a target and for focusing the IR radiation on a secondary mirror;

a secondary mirror mounted in the said nose cone for receiving the IR radiation from said primary mirror and for focusing the IR radiation on a plurality of IR transmissive elements;

said plurality of IR transmissive elements being positioned around the periphery of said primary mirror for receiving the IR radiation from said secondary mirror;

a shaped-charge positioned behind said primary mirror; and means located about the periphery of said shaped-charge for transmitting the IR information from the IR transmissive elements to a location aft of said shaped-charge.

9. The system according to claim 8 wherein:

said primary mirror is concave.

10. The system according to claim 9 wherein:

said secondary mirror is convex and is mounted at the focus of said primary mirror.

11. The system according to claim 10 wherein:

said primary mirror and said secondary mirror each are formed with thin center sections to provide for less restrictive passage for an explosive jet of said shaped-charge.

12. The system according to claim 8 wherein:

said IR transmissive elements are equiangularly spaced about the periphery of said primary mirror.

13. The system according to claim 8 wherein;

said IR transmissive elements comprise an array of IR conductive fiber optics.

14. The system according to claim 8 further comprising:

a ring-shaped spacer means positioned between said shaped-charge and said primary mirror for separating said shaped charge from said primary mirror.

* * * * *